US010130160B1

(12) United States Patent
Cheng et al.

(10) Patent No.: US 10,130,160 B1
(45) Date of Patent: Nov. 20, 2018

(54) BACKPACK WITH QUICK DEPLOYING BODY ARMOR

(71) Applicants: Carson Cheng, City of Industry, CA (US); Peng Zhang, City of Industry, CA (US); Richard Thomas, City of Industry, CA (US)

(72) Inventors: Carson Cheng, City of Industry, CA (US); Peng Zhang, City of Industry, CA (US); Richard Thomas, City of Industry, CA (US)

(73) Assignee: NcSTAR, Inc., City of Industry, CA (US)

( * ) Notice: Subject to any disclaimer, the term of this patent is extended or adjusted under 35 U.S.C. 154(b) by 0 days.

(21) Appl. No.: 15/898,907

(22) Filed: Feb. 19, 2018

(51) Int. Cl.
*A45F 3/06* (2006.01)
*A45F 4/02* (2006.01)
*F41H 1/02* (2006.01)

(52) U.S. Cl.
CPC ..... *A45F 3/06* (2013.01); *A45F 4/02* (2013.01); *F41H 1/02* (2013.01)

(58) Field of Classification Search
CPC ..... A45F 3/04; A45F 3/06; A45F 4/02; F41H 1/00; F41H 1/02
USPC ..... 224/153, 581
See application file for complete search history.

(56) References Cited

U.S. PATENT DOCUMENTS 4,830,245 A * 5/1989 Arakaki ..... A45F 3/04 2/2.5
5,031,733 A * 7/1991 Chang ..... A41D 15/04 190/1
5,337,934 A * 8/1994 Johnson ..... A41D 13/0012 224/148.5
5,657,917 A * 8/1997 Johnson ..... A45F 3/04 224/153
5,676,293 A * 10/1997 Farris ..... A45F 3/04 2/175.7
5,946,729 A * 9/1999 Sakurai ..... A42B 1/08 2/202
6,010,051 A * 1/2000 Callanan ..... A45F 3/04 224/237
6,161,738 A * 12/2000 Norris ..... A45C 9/00 109/49.5
6,419,132 B1 * 7/2002 Reed ..... A45C 15/00 109/49.5
6,685,071 B2 * 2/2004 Prather ..... A45C 15/00 2/2.5

(Continued)

*Primary Examiner* — Justin Larson

(57) ABSTRACT

A backpack with quick deploying body armor includes a backpack having a front compartment and rear compartment which has an opening on the top of the backpack; the opening can be closed by a flap which has open and closed positions; the flap can be locked to the top of the backpack. A rear ballistic panel is attached to the vertical face of the rear compartment. A front ballistic panel module has two connecting straps connecting to the bottom face of the rear compartment and two pulling straps. The front ballistic panel module has a storage position and deployed position. In the storage to position, the front ballistic panel is in the rear compartment and the pulling straps are attached to the shoulder straps of the backpack. In the deployed position, the front ballistic panel is out of the rear compartment and the pulling strap is fastened to the body of the wearer by connecting the end of the pulling strap.

13 Claims, 5 Drawing Sheets

(56) References Cited

U.S. PATENT DOCUMENTS

| | | | | |
|---|---|---|---|---|
| 7,036,420 | B1 * | 5/2006 | Kummerer | A45F 3/06 190/109 |
| 7,316,340 | B2 * | 1/2008 | Marik | A45F 3/04 224/631 |
| D569,043 | S * | 5/2008 | Crye | D29/100 |
| 7,441,278 | B2 * | 10/2008 | Blakeley | F41C 33/06 2/102 |
| 8,387,843 | B2 * | 3/2013 | Kramer | A45F 3/08 224/581 |
| 8,887,976 | B2 * | 11/2014 | Vierthaler | A45F 3/08 224/631 |
| 9,820,558 | B1 * | 11/2017 | de Geus | A45F 4/02 |
| 9,949,557 | B2 * | 4/2018 | Crimaldi | A45F 3/10 |
| 2009/0014490 | A1 * | 1/2009 | Bradley | A45C 13/008 224/576 |
| 2010/0230458 | A1 * | 9/2010 | Kramer | A45F 3/08 224/581 |
| 2016/0022016 | A1 * | 1/2016 | Wolffe | A45F 3/04 224/581 |

* cited by examiner

BACKPACK WITH QUICK DEPLOYING BODY ARMOR

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to backpacks, and specifically to backpacks with body armor(s).

DESCRIPTION OF RELATED ARTS

Conventional bulletproof equipment is typically comprised of a vest that contains two ballistic panels, one in the front pocket and one in the back pocket of the vest. This kind of bulletproof vest is commonly used in the Army or by law enforcement officers but is rarely used by civilians because the vest is heavy, bulky and difficult to conceal, especially in the summer.

Another type of bulletproof equipment is the bulletproof backpack, which has a compartment to contain a ballistic panel. The bulletproof backpack is good for daily carry by civilians because the panel is easy to conceal in the backpack. But this type of backpack can only protect the back or front of a wearer, depending on how they carry it.

In order to protect both the front and rear side of a wearer's body, some convertible suitcases and backpacks are proposed, for example, in U.S. Pat. No. 5,031,733 and U.S. Pat. No. 7,441,278. This type of backpack or suitcase can be disassembled and then converted to a bulletproof vest. The user can carry the equipment as a backpack or a suitcase but wear it as a vest in emergency. However, a wearer is required to take off the backpack or suitcase in order to convert them into a bulletproof vest and then put them on, which is time consuming and could be costly in case of an emergency.

SUMMARY OF THE PRESENT INVENTION

The invention is advantageous in that it provides a backpack that a wearer can quick-deploy the ballistic panel and fasten it on the body of the wearer without taking off the backpack. This backpack pack converts to a bulletproof vest in seconds and protects both the front and back of the wearer.

Another advantage of the invention is to provide a quick and easy access to the pulling strap of the ballistic panel. The pulling straps are attached to the shoulder straps of the backpack when the ballistic panel is in the compartment of the backpack.

Another advantage of the invention is to provide a quick fastening of the ballistic panel to the body of the wearer after the ballistic panel had been deployed. Detachable connecting component is fixed to the end of the pulling straps.

Another advantage of the invention is to provide an independent compartment for the ballistic panel. The other various items are stored in a different compartment, so the ballistic panel won't interfere with ordinary usage of the main compartment of the backpack.

Another advantage of the invention is to provide adjustable straps that connect the ballistic panel and backpack. When the ballistic panel is deployed, the gap between the backpack and ballistic panel can be adjusted for different sizes of heads or helmets.

Another advantage of the invention is to provide a detachable connection between the connecting straps of the ballistic panel and the backpack. The wearer can take off the ballistic panel and use it independently.

Another advantage of the invention is to provide a flap cover, which is lockable, on the top surface of the backpack to conceal the ballistic panel when it is in the compartment of the backpack. The locking components between the flap and top face of the backpack are used to prevent the ballistic panel from slipping out accidentally.

Additional advantages and features of the invention will become apparent from the description which follows and may be realized by means of the instrumentalities and combinations particularly pointed out in the appended claims.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

It is appreciated that the terms "upper", "lower". "front", "rear", "left", "right", vertical", "horizontal", "top". "bottom", "exterior", and "interior" in the following description refer to the orientation or positioning relationship in the accompanying drawings for easy understanding of the present invention without limiting the actual location or orientation of the present invention. Therefore, the above terms should not be an actual location limitation of the elements of the present invention.

Figure 1:
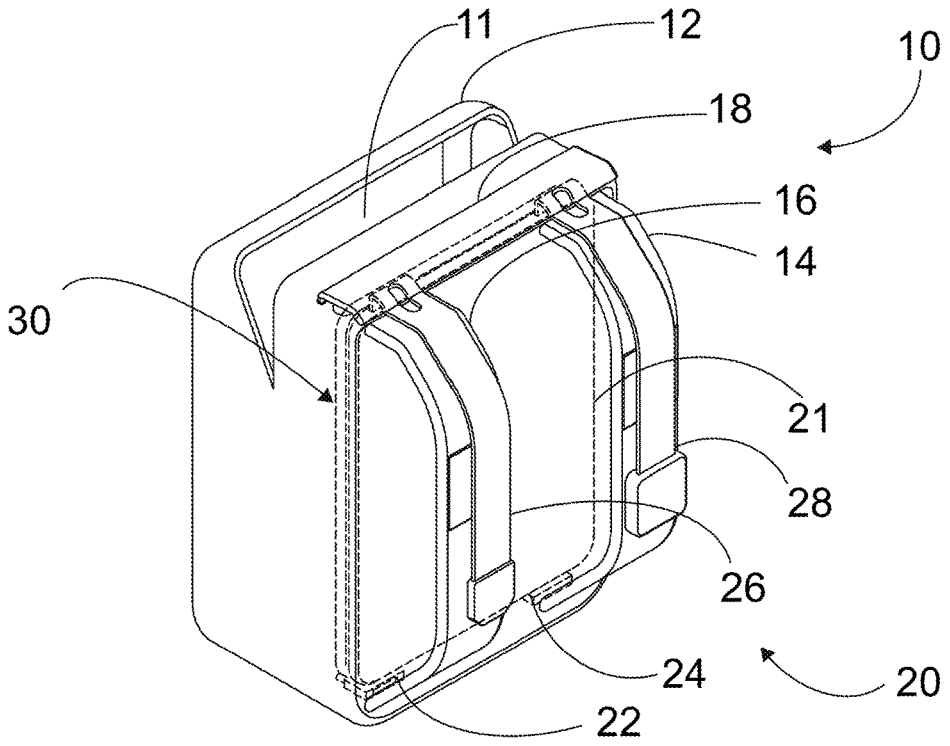
FIG. 1 is a top, rear perspective view of the invention, with the flap cover in closed position and two ballistic panels in storage position. Two ballistic panels are shown with dotted lines.

On embodiment of the closure illustrated in FIGS. 1 (front ballistic panel is in storage position) and 6 (front ballistic panel is in deployed position), the bulletproof backpack comprises a backpack module 10, a front ballistic panel module 20, and a rear ballistic panel 30.

A backpack module 10 comprises a main backpack body 12, a front compartment 11, a rear compartment 13, a flap cover 18, left shoulder strap 14 and right shoulder strap 16.

A front ballistic panel module 20 comprises a main ballistic panel 21, a left pulling strap 28, a right pulling strap 26, a left connecting strap 24 and a right connecting strap 22.

As shown in FIGS. 3, 4, 5, 7 and 9, the main backpack body 12 comprises a horizontal base 121, a horizontal top 122, a vertical right-side face 123, a vertical left-side face 124, a vertical front face 126, and a vertical rear face 125.

The front compartment 11 has an opening 112 that can be closed by attaching the edge of the opening 112. The attaching method can be zip lock, Velcro® fasten and so on. The rear compartment 13 has an opening 132 that can be closed by the flap cover 18 which is attached on the top face 122 of the backpack body 12. The flap cover is positioned between the opening 112 of the front compartment and opening 132 of the rear compartment 13. The rear compartment 13 also consists of a vertical side wall 134 and a bottom face 136 which is shown in FIG. 7.

Figure 2:
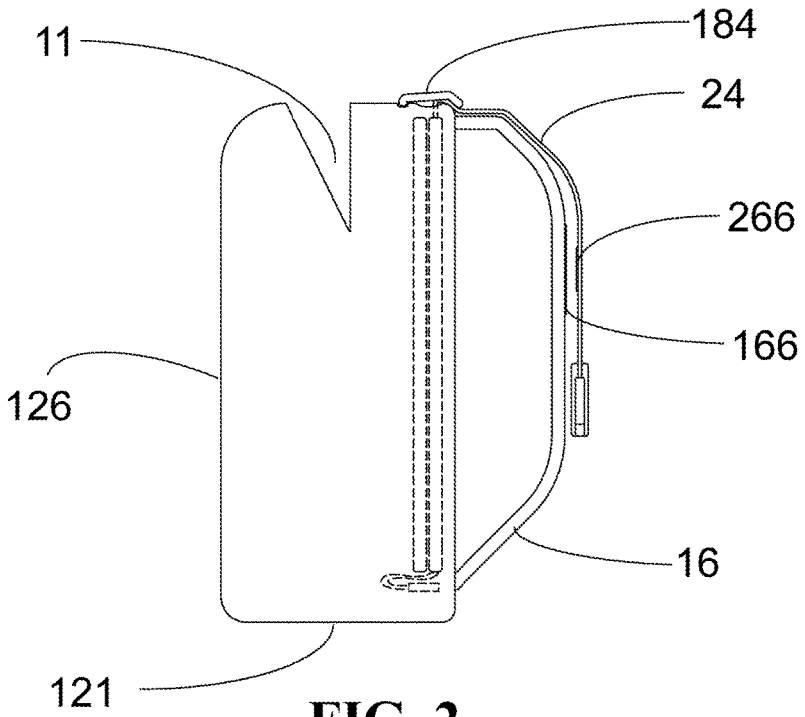
FIG. 2 is a side view of the invention, with the flap cover in closed position and two ballistic panels in storage position. Two ballistic panels are shown with dotted lines.
Figure 3:
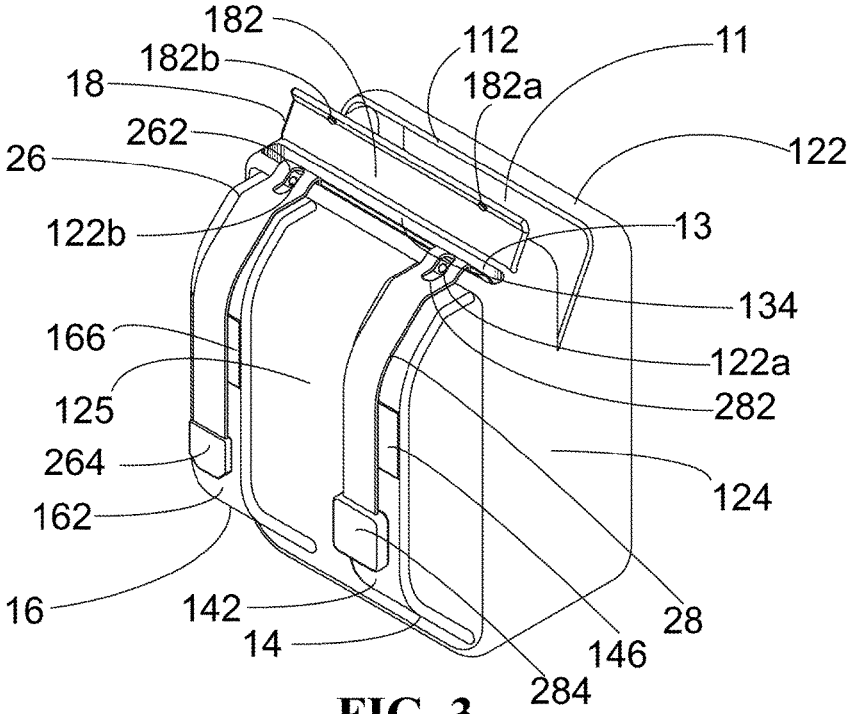
FIG. 3 is a top, rear perspective view of the invention, with the flap cover in open position and two ballistic panels in storage position.
Figure 4:
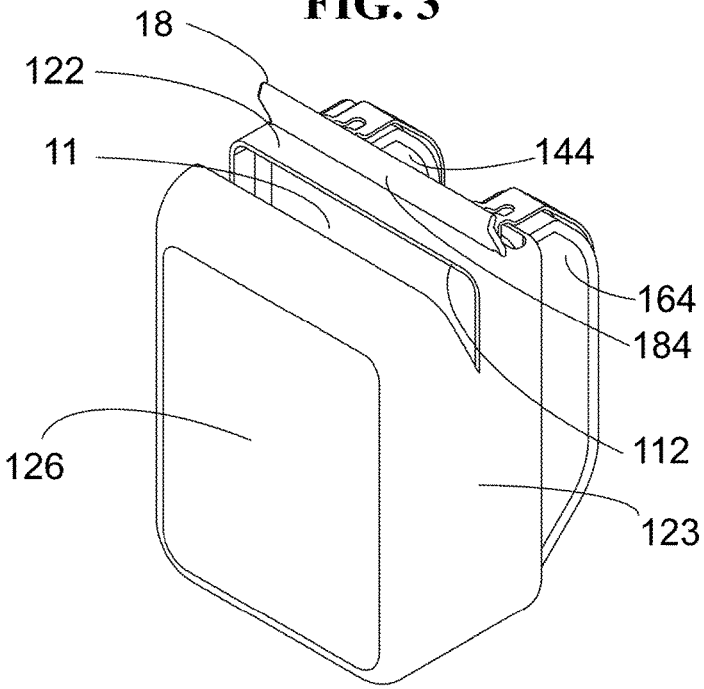
FIG. 4 is a top, front perspective view of the invention, with the flap cover in open position and two ballistic panels in storage position.

The flap cover 18 comprises a top face 184 and bottom face 182. The cover 18 has an open position as shown in FIGS. 3, 4, 5 and 6 as well as a closed position as shown in FIGS. 1 and 2. In the closed position, the flap cover is locked to the top surface 122 by fastening detachable closure 182*a* and 182*b* with 122*a* and 122*b* which are likewise detachable.

The left shoulder strap 14 and right shoulder strap 16 are fixed to the rear face 125 of the main backpack 12. The left shoulder strap 14 has external face 142 and internal face 144. Likewise, the right shoulder strap 16 has external face 162 and internal face 164. When the front ballistic panel 21 is in storage position, left shoulder strap 14 is attached with left pull strap 28 by fastening detachable component 146 with component 286, which is likewise detachable, on shoulder strap 28. The right shoulder strap 16 is attached with right pull strap 26 by fastening detachable component 166 with component 266, which is likewise detachable, on shoulder strap 26. The detachable components can be magnet, Velcro® and so on.

Figure 6:
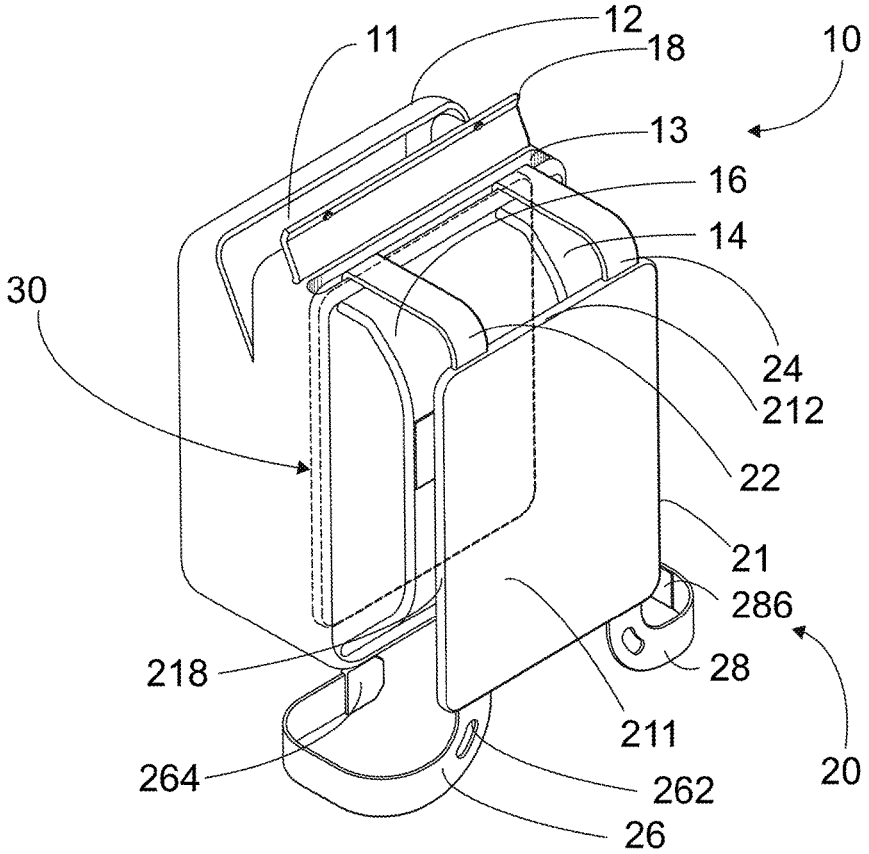
FIG. 6 is a top, rear perspective view of the invention, with the flap cover in to open position, one ballistic panel in storage position and another ballistic panel in deployed position. The ballistic panel in storage position is shown with dotted lines.
Figure 7:
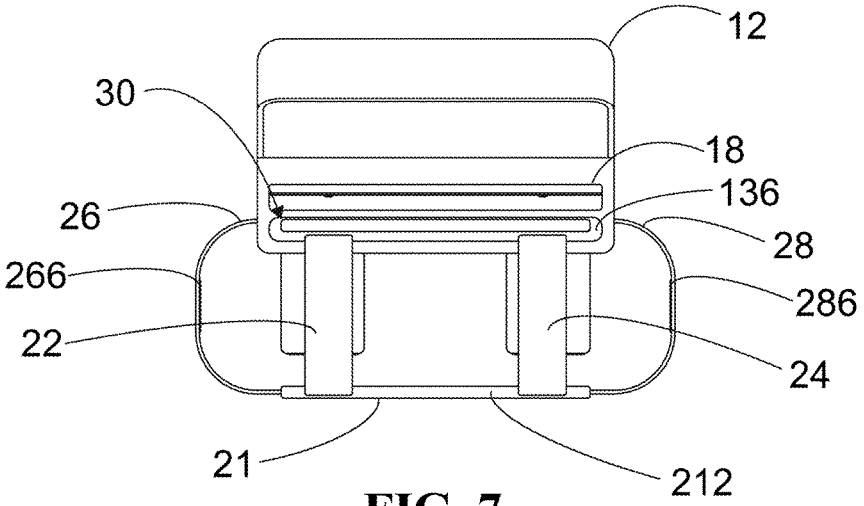
FIG. 7 is a top view of the invention, with the flap cover in open position, one ballistic panel in storage position and another ballistic panel in deployed position.
Figure 8:
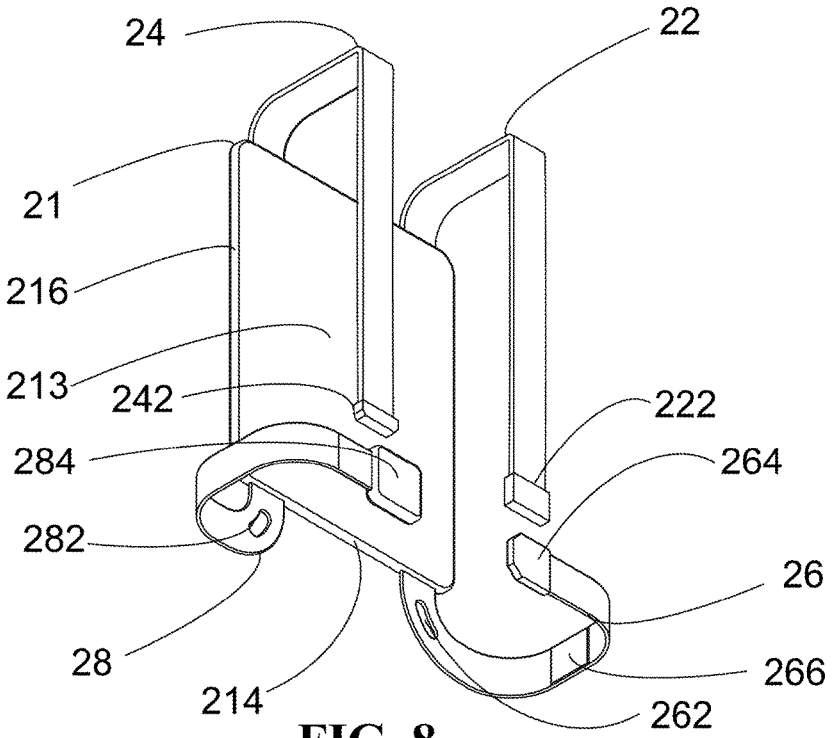
FIG. 8 is a perspective view of the ballistic panel with connecting straps and pulling straps.
Figure 9:
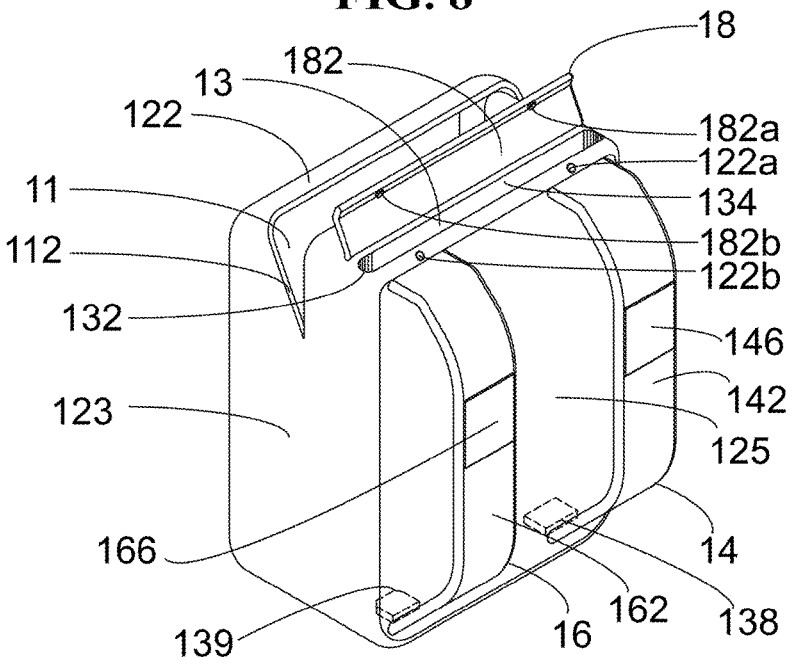
FIG. 9 is a perspective view of the backpack only, with flap cover in open position.

As shown in FIGS. 6, 7 and 8, the main ballistic panel 21 of front ballistic panel 20 has a top face 212, a bottom face 214, a left face 216, a right face 218, a front face 211 and a rear face 213.

The left connecting strap 24 is fixed to the top face 212 of main ballistic panel 21 and the other end of the connecting strap 24 is fixed to the bottom surface 136 of compartment 13 by connecting detachable fasten component 242 with detachable fasten component 138. Likewise, the right connecting strap 22 is fixed to the top face 212 of main ballistic panel 21 and the other end of the connecting strap 22 is fixed to the bottom surface 136 of compartment 13 by connecting detachable fasten component 242 with detachable fasten component 139. The detachable connecting components can be clip, magnetic, Velcro® and so on.

The left pulling strap 28 is fixed to the bottom face 214 of the main ballistic panel 12. Likewise, the right pulling strap 26 is also fixed to the bottom face 214 of the main ballistic panel 12. The left pulling strap 28 can be fastened with the right pulling strap by connecting a detachable component 284 on left pulling strap 28 and a detachable component 264 on right pulling strap 26. The length of the left pulling strap 28 and the right pulling strap 26 are adjustable for different waist sizes.

A slot 282 on left pulling strap 28 is used for unlocking the connection between the locking spot 182*a* on the bottom face of the flap cover 18 and the locking spot 122*a* on the top face 122 of the backpack. Likewise, a slot 262 on right pulling strap 26 are used for unlocking the connection between locking spot 182*b* on the bottom face of the flap cover 18 and the locking spot 122*b* on the top face 122 of the backpack.

FIGS. 1 (front ballistic panel is in storage position), 5 (front ballistic panel is pulled half way out of the compartment) and 6 (front ballistic panel is in deployed position) show the converting process of front ballistic panel from storage position to deployed position.

As shown in FIG. 1, the ballistic panel is in storage position. The connecting strap 22 and 24 are fixed to the bottom face 136 of the rear compartment 13 by fastening detachable components 242 and 138 as well as detachable components 222 and 139. The pulling strap 26 and 28 are attached to shoulder strap 16 and 14 by connecting detachable components 166 and 266 as well as detachable components 146 and 286. The flap cover 18 is in closed position. The locking point 182*b* on the bottom face 182 of flap 18 is connected with locking point 122*b* on the top face 122 of the main backpack body 12 through the unlocking hole 262 on the pulling strap 26. Likewise, the locking point 182*a* on the bottom face 182 of the flap 18 is connected with locking point 122*a* on the top face 122 of the main backpack body 12 through the unlocking hole 262 on the pulling strap 26.

Figure 5:
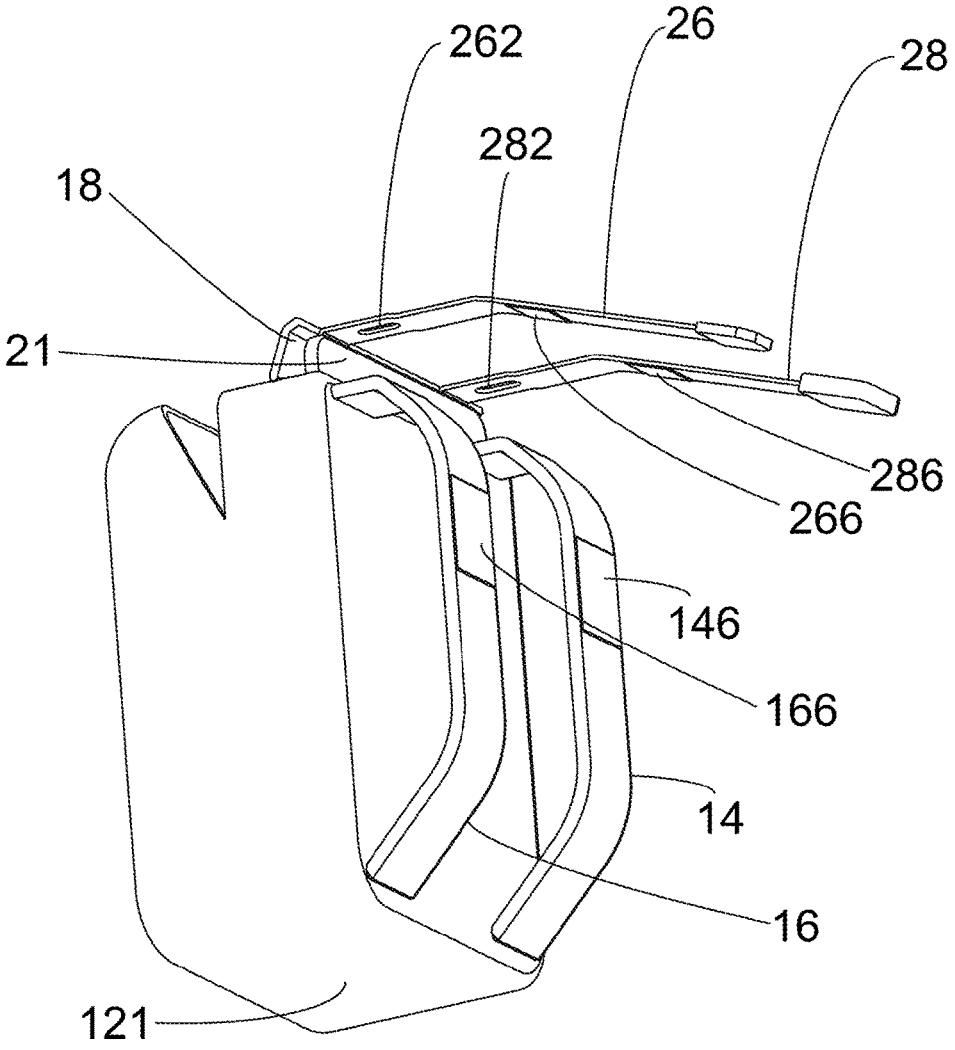
FIG. 5 is a bottom, rear perspective view of the invention, with the flap in open position and front ballistic panel is half way out of the backpack.

As shown in FIG. 5, when a wearer starts pulling the pulling straps 26 and 28, the fasten component 266 on pulling strap 26 is detached from the fasten component 166 on the shoulder strap 16. Likewise, the fasten component 286 on pulling strap 28 is detached from the fasten component 146 on the shoulder strap 14. As the wearer pulls further, the slot 262 on pulling strap 26 then unlocks the connection between 182*b* on the bottom face 182 of the cover 18 and 122*b* on the top face 122 of backpack body 12. Likewise, the slot 282 on pulling strap 28 then unlocks the connection between 182*a* on the bottom face 182 of the cover 18 and 122*a* on the top face 122 of backpack body 12. The front ballistic panel then pushes the flap and moves upwardly.

As shown in FIG. 6, the front ballistic panel 21 is fully pulled out from the compartment 13. The front panel 21 is in deployed position. The detachable component 284 on pulling strap 28 then can be fastened with and the detachable component 264 on pulling strap 26, affixing the ballistic panel on the upper body of the wearer. The front ballistic panel in deployed position can protect the front body of the wearer. While the rear ballistic panel 30 is still in the compartment 13 to protect the back of the wearer.

As shown in FIG. 8, the front ballistic panel can also be detached from the backpack and be used independently. The connecting straps can be wrapped around the neck of the wearer by fastening the detachable component 242 on connecting strap 24 with detachable component 222 on pulling strap 22. Likewise, the pulling straps can be fastened to the waist of the wearer by connecting the detachable component 284 on pulling strap 28 and detachable component 264 on pulling strap 26.

What is claimed is:

1. A backpack, comprising:

a compartment having an opening;

two shoulder straps connected to the backpack;

a ballistic body armor that can be moved, through the opening, from a storage position to a deployed position;

two pulling straps fixing to the body armor and detachably fastened to the shoulder straps when the ballistic body armor is stored in the compartment, wherein said compartment can be closed by a flap cover fixed on the top face of the backpack, wherein said flap cover has at least two detachable locking spots to lock to the said backpack;

wherein each of said pulling straps has a slot to unlock the locking spots on the said flap cover from said backpack.

2. The backpack, as recited in claim 1, wherein each said pulling strap has at least one detachable connecting component.

3. The backpack, as recited in claim 1, wherein each said shoulder strap has at least one detachable connecting component.

4. The backpack, as recited in claim 1, wherein said a ballistic body armor has two connecting straps fastened to the internal surface of the compartment in backpack.

5. The backpack, as recited in claim 1, wherein each of said pulling straps has a detachable connecting component at an end thereof, wherein the connecting components can be fastened to each other.

6. The backpack, as recited in claim 1, wherein each of said pulling straps has an ability to adjust the length.

7. The backpack, as recited in claim 1, wherein said backpack has another compartment besides the compartment for the ballistic panel.

8. The backpack, as recited in claim 4, wherein each of said two connecting straps has a detachable fastening component at the end.

9. The backpack, as recited in claim 8, wherein said detachable fastening components at the end of each connecting strap can be connected to each other.

10. The backpack, as recited in claim 4, wherein each of said two connecting straps has an ability of adjusting length.

11. The backpack, as recited in claim 10, wherein said ability of adjusting length is such that the opening made by the two connecting straps, backpack and ballistic panel allows the head of a wearer to go through.

12. The backpack, as recited in claim 1, wherein said compartment has another rear ballistic panel in the compartment.

13. The backpack, as recited in claim 12, wherein said rear ballistic panel is detachably fastened to the internal surface of the compartment.

* * * * *